US007025711B2

(12) United States Patent
Eschenbach

(10) Patent No.: US 7,025,711 B2
(45) Date of Patent: Apr. 11, 2006

(54) ORBITAL EXERCISE MACHINE WITH ARM EXERCISE

(76) Inventor: Paul William Eschenbach, 290 S. Tyger La., Roebuck, SC (US) 29376

( * ) Notice: Subject to any disclaimer, the term of this patent is extended or adjusted under 35 U.S.C. 154(b) by 28 days.

(21) Appl. No.: 10/921,244

(22) Filed: Aug. 19, 2004

(65) Prior Publication Data

US 2006/0040795 A1 Feb. 23, 2006

(51) Int. Cl.
*A63B 22/04* (2006.01)
*A63B 69/16* (2006.01)

(52) U.S. Cl. ..... 482/52; 482/57

(58) Field of Classification Search ..... 482/51–53, 482/57, 70, 79–80
See application file for complete search history.

(56) References Cited

U.S. PATENT DOCUMENTS

| | | | | |
|---|---|---|---|---|
| 5,647,821 | A * | 7/1997 | Johnston | 482/57 |
| 5,895,339 | A | 4/1999 | Maresh | 482/51 |
| 5,919,118 | A | 7/1999 | Stearns et al. | 482/51 |
| 5,957,814 | A | 9/1999 | Eschenbach | 482/51 |
| 6,042,512 | A | 3/2000 | Eschenbach | 482/52 |
| 6,045,487 | A * | 4/2000 | Miller | 482/52 |
| 6,146,314 | A * | 11/2000 | Lee | 482/57 |
| 6,217,485 | B1 | 4/2001 | Maresh | 482/52 |
| 6,217,486 | B1 | 4/2001 | Rosenow | 482/52 |
| 6,238,321 | B1 | 5/2001 | Arnold et al. | 482/52 |
| 6,248,045 | B1 | 6/2001 | Stearns et al. | 482/52 |
| 6,361,476 | B1 | 3/2002 | Eschenbach | 482/52 |
| 6,416,442 | B1 | 7/2002 | Stearns et al. | 482/52 |
| 6,540,646 | B1 | 4/2003 | Stearns et al. | 482/52 |
| 6,565,486 | B1 | 5/2003 | Stearns et al. | 482/52 |
| 6,645,125 | B1 | 11/2003 | Stearns et al. | 482/52 |

* cited by examiner

*Primary Examiner*—Stephen R. Crow

(57) ABSTRACT

The present invention relates to a standup exercise apparatus that simulates walking, jogging and climbing with arm exercise. More particularly, the present invention relates to an exercise machine having separately supported pedals for the feet and arm exercise coordinated with the motion of the feet. Elliptical cross trainers guide the feet along a generally elliptical shaped curve to simulate the motions of jogging and climbing. Existing elliptical cross trainers often use excessive pedal articulation which can overwork the ankle to achieve a longer stride. The present invention is an improved elliptical exercise machine capable of extended exercise with less pedal articulation that is more ankle friendly. One end of a foot support member is guided by a guide link for back and forth movement while the other end is guided by an orbital link to drive an alternator and flywheel. The resulting pedal motion is foot friendly. Handles are coordinated with the foot support members for arm exercise.

19 Claims, 4 Drawing Sheets

ORBITAL EXERCISE MACHINE WITH ARM EXERCISE

BACKGROUND OF THE INVENTION

1. Field

The present invention relates to a standup exercise apparatus that simulates walking, jogging and climbing with arm exercise. More particularly, the present invention relates to an exercise machine having separately supported pedals for the feet and arm exercise coordinated with the motion of the feet.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Generally they are large exercise machines using long cranks to generate a long foot stride. There is a need for an elliptical exercise machine capable of a similar long stride using a linkage to modify a shorter crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

Eschenbach in U.S. Pat. No. 5,957,814 shows the use of an orbital link in a front drive elliptical design. Several rear drive elliptical cross trainers are shown by Eschenbach in U.S. Pat. Nos. 6,042,512 and 6,361,476. Rosenow in U.S. Pat. No. 6,217,486 and Arnold et al. in U.S. Pat. No. 6,238,321 show typical commercial rear drive elliptical cross trainers in use today.

Maresh in U.S. Pat. Nos. 5,895,339 and 6,217,485 offers the use of a crank-rocker linkage to drive the rear end of a foot support member for an elliptical cross trainer. Stearns et al. show various ways to use a crank-rocker linkage to drive the rear end of an elliptical cross trainer in U.S. Pat. Nos. 5,919,118, 6,217,485, 6,248,045, 6,416,442, 6,540,646, 6,565,486 and 6,645,125.

There is a need for a pedal operated exercise machine that can be safely operated in the standup position whereby the arms and legs can be exercised with the feet moving through a generally elliptical movement without excessive pedal articulation.

It is one objective of this invention to provide an elliptical pedal movement with a path generating linkage that provides a long stride with less pedal articulation. Excessive pedal articulation causes ankle stress. Another object of this invention is to provide arm exercise that is coordinated with the pedal movement.

SUMMARY OF THE INVENTION

The present invention relates to the kinematic motion control of pedals which simulate running, climbing and cycling during several modes of operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles vary during the pedal cycle to maintain the heel of the foot in contact with the pedal with less pedal articulation. As the foot is raised, the heel of the foot remains generally in contact with the inclining pedal for safer operation. Arm exercise is by arm levers coordinated with the mechanism guiding the foot pedals.

In the preferred embodiment, the apparatus includes a separate pedal for each foot, each pedal being extended by a foot support member and partially supported by an orbital oblong guide path at the first portion of the foot support member. The oblong guide path generating linkage has a rotary crank arm which completes one full revolution during a pedal cycle and is phased generally opposite the crank arm for the other pedal through a crankshaft pivot axis attached to the framework. A rocker link is pivotally connected to the framework. A coupler link is connected to the crank at a crank arm pivot and the rocker link is connected to the coupler link at a rocker pivot to form a crank-rocker mechanism. An orbital link is also connected to the crank arm pivot configured so that all portions of the orbital link traverse orbital paths as the crank arm rotates. This is accomplished by the addition of a connector link pivotally connected to the orbital link and to the rocker link.

A second portion of the foot support member is supported with a pivot by a guide link which is pivotally connected to the framework. As the crank arms are driven by foot motion, the pedals follows an elongate curve approximating an ellipse having less pedal articulation than other elliptical cross trainers having long crank arms.

Arm exercise is provided with handles pivotally connected to the framework and coordinated with the guide links. When the foot is forward, the handle corresponding to that foot is generally rearward.

Load resistance is imposed upon the crank arms through pulleys and belts from a flywheel and alternator. A control system regulates the load on the alternator to vary the resistance to exercise. The resistance can be varied during operation through a control system within easy reach of the operator. Other forms of load resistance such as friction, magnetic, air, belt, etc. may also be used.

In an alternate embodiment, the same components of the path generating linkage of the first embodiment are arranged in a different manner. The connector links are moved from below the coupler links to being positioned above the coupler links. Both embodiments cause the first portion of the foot support member to follow an elongate orbital path similar to an ellipse where the longer major axis of the ellipse is generally horizontal to provide the longer stride length. The shorter minor axis of the ellipse results in less pedal articulation.

In summary, this invention provides the operator with stable foot pedal support having motions that simulate running, climbing and cycling with very low joint impact and upper body exercise. The pedal motion exhibits a long stride with less pedal articulation common to other elliptical trainers for less ankle stress.

DETAILED DESCRIPTION OF THE EMBODIMENTS

Figure 1:
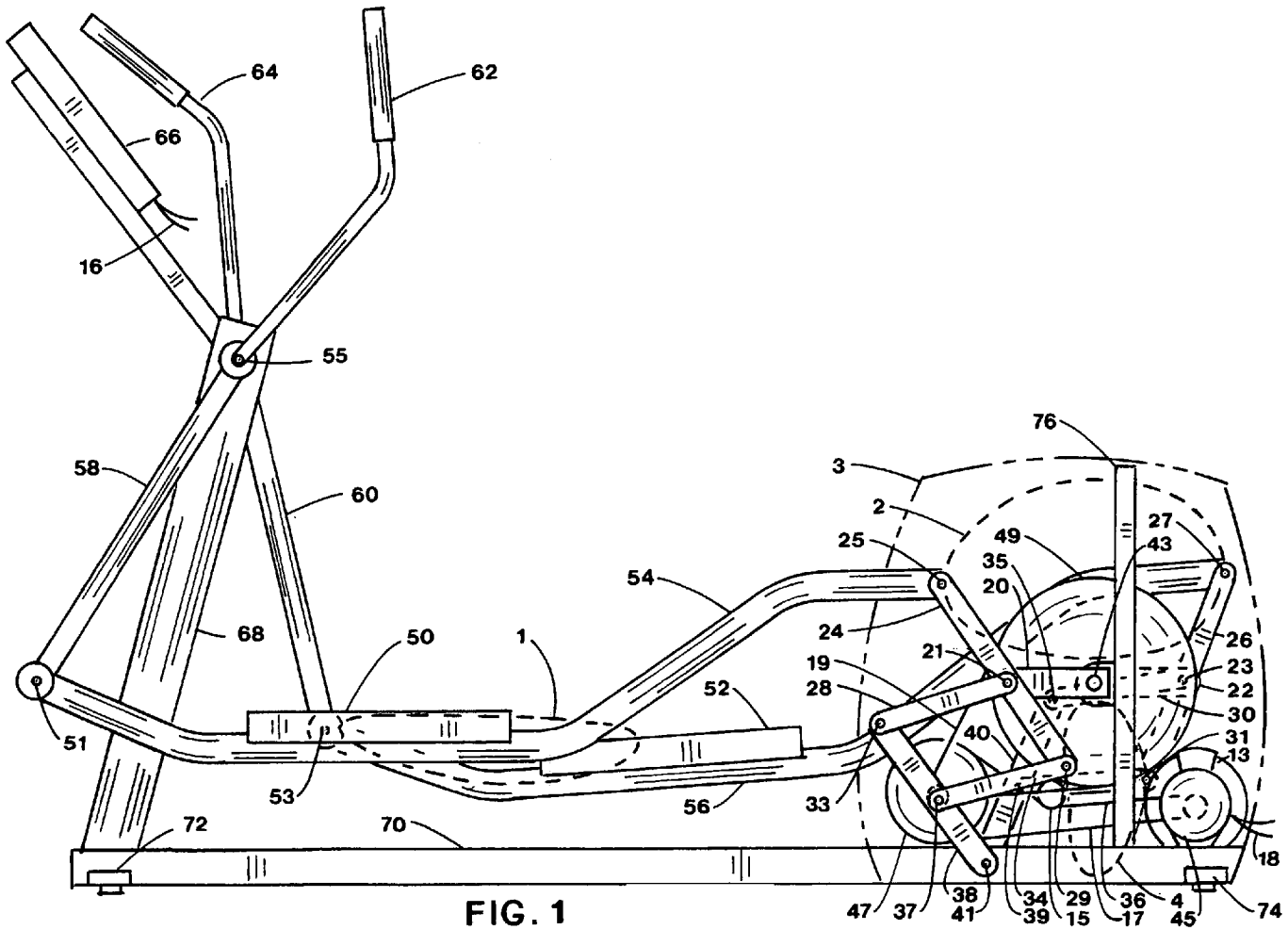
FIG. 1 is a right side elevation view of the preferred embodiment of an exercise machine constructed in accordance with the present invention.
Figure 2:
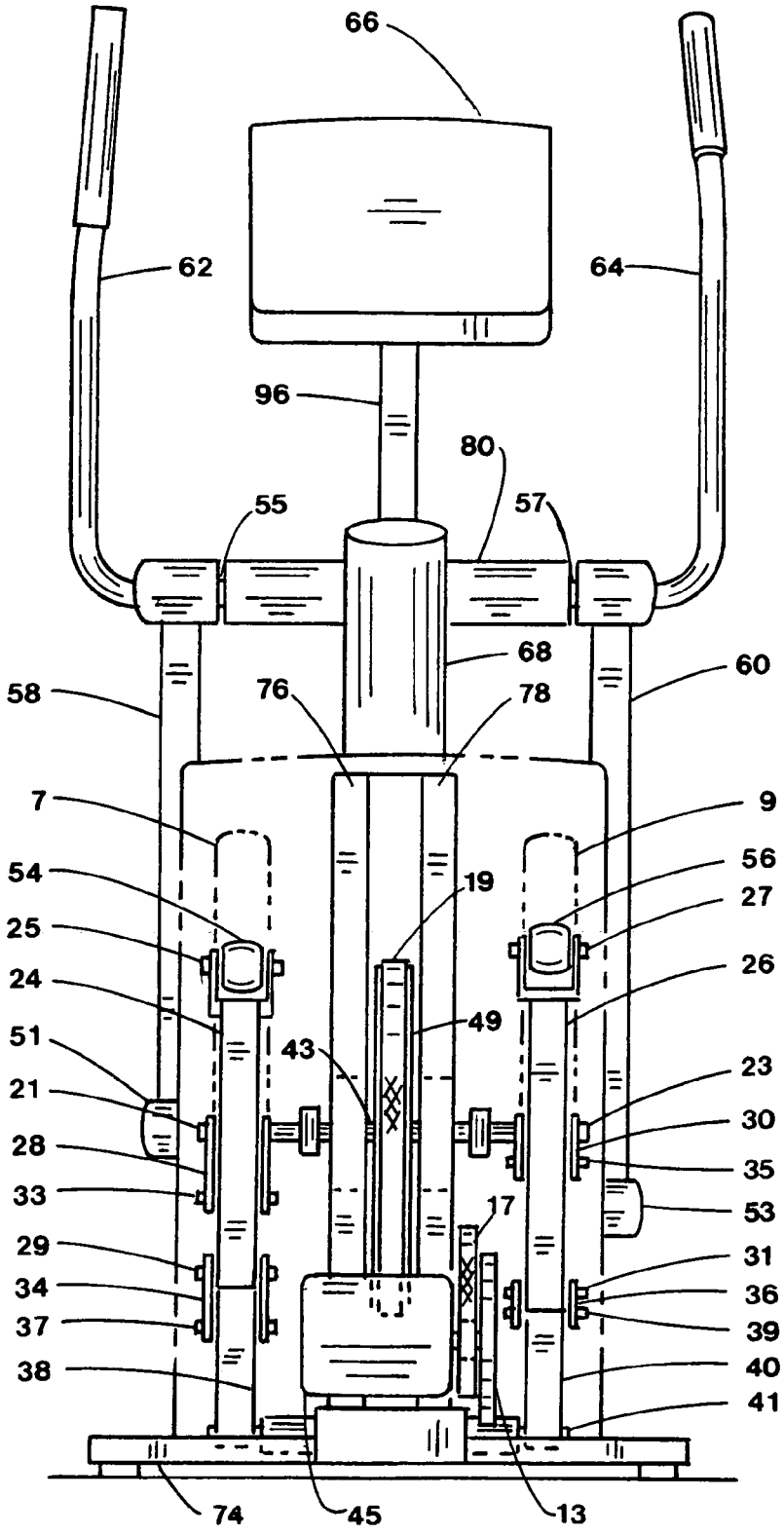
FIG. 2 is the rear view of the preferred embodiment shown in FIG. 1.

Referring to the drawings in detail, pedals 50 and 52 are shown in FIGS. 1 and 2 in the most forward and rearward positions of the first embodiment. Pedals 50 and 52 are supported by foot support members 54 and 56 and traverse an elongate closed loop path 1. Foot support members 54,56 are connected to guide links 58,60 at pivots 51,53 and connected to orbital links 24,26 at pivots 25,27. Guide links 58,60 are connected to frame member 80 at pivots 55,57.

Orbital links 24,26 are connected to crank arms 20,22 and coupler links 28,30 intermediate the ends at pivots 21,23. Crank arms 20,22 are joined as generally opposed at pivot axis 43 to form a crank. Rocker links 38,40 are connected to frame member 70 at pivots 41 and to coupler links 28,30 at pivots 33,35. As crank arms 20,22 complete a revolution, rockers 38,40 oscillate about pivots 41.

Connector links 34,36 are connected to rocker links 38,40 at pivots 37,39 and to orbital links 24,26 at pivots 29,31. Each portion of orbital links 24,26 follow orbiting paths such as orbital path 2 traversed by pivots 25,27 and orbital path 4 traversed by pivots 29,31.

Orbital links 24,26, cranks arms 20,22, rocker links 38,40, coupler links 28,30 and connector links 34,36 form a pair of path generating linkages configured to guide the first portion of the foot support member 54,56 along orbital path 2. For this embodiment, note that path 2 followed by the end of foot support members 54,56 does not orbit pivot axis 43.

Handles 62,64 are attached to guide links 58,60 for arm exercise. Pulley 49 is attached to crank arms 20,22 and rotates about pivot axis 43 to drive alternator 45 and flywheel 13 through belts 17,19 and step-up pulley 47. Alternator 45 is supported by frame 70 and is connected to controller 66 by wires 16,18 using conventional wiring (not shown). Controller 66 is attached to frame member 68 by support 96 and works with alternator 45 to provide variable resistance to exercise using conventional methods.

Horizontal member 80 supports guide pivots 55,57 and is attached to frame member 70 by upright support 68. Crank pivot axis 43 is supported by upright members 76,78 which are attached to frame member 70. Cross members 72,74 are supported by the floor and attach to frame member 70. Pulley 47 is supported by a pulley support (not shown) attached to frame member 70.

Figure 3:
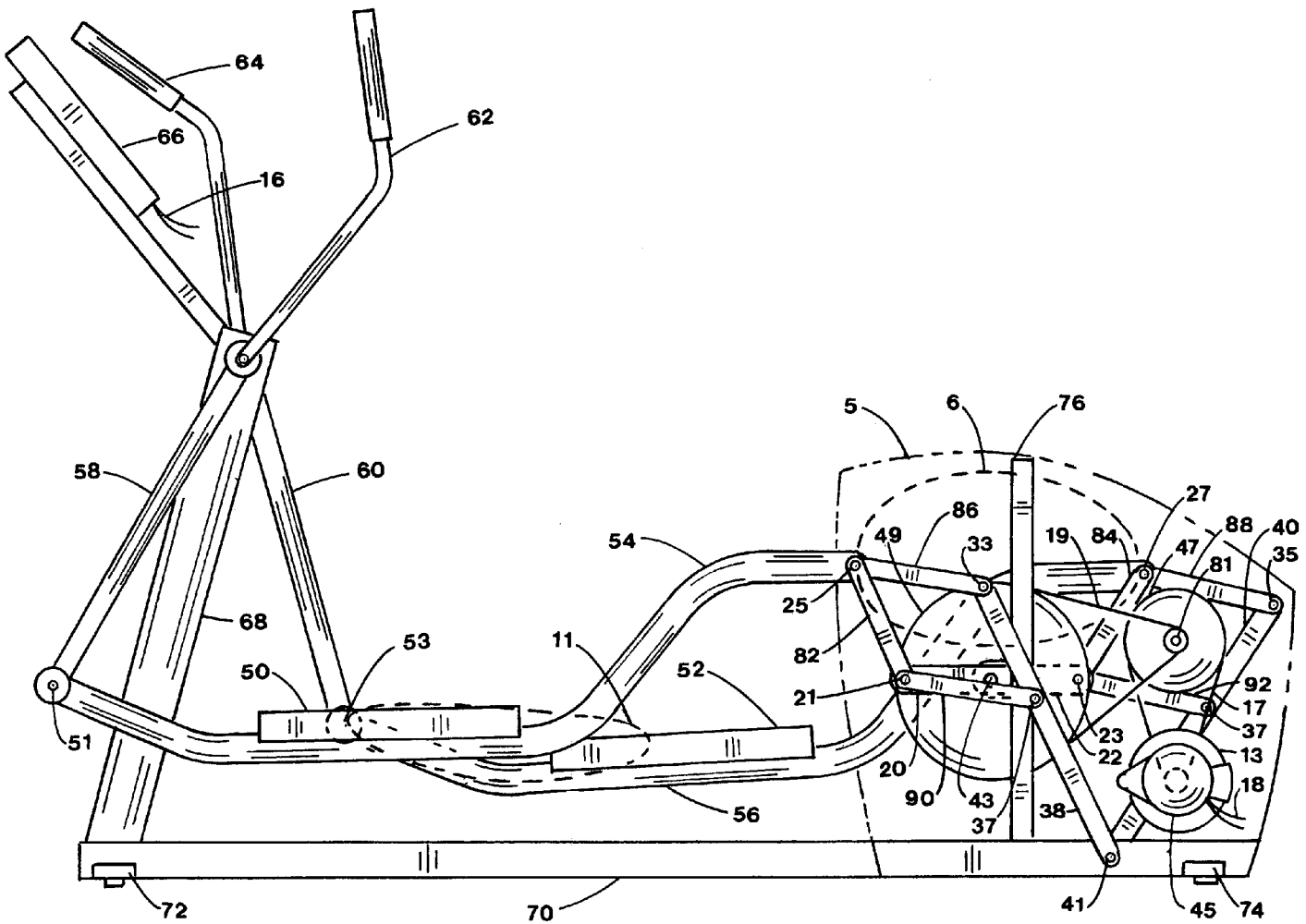
FIG. 3 is is a side elevation view of an alternate embodiment of the present invention.
Figure 4:
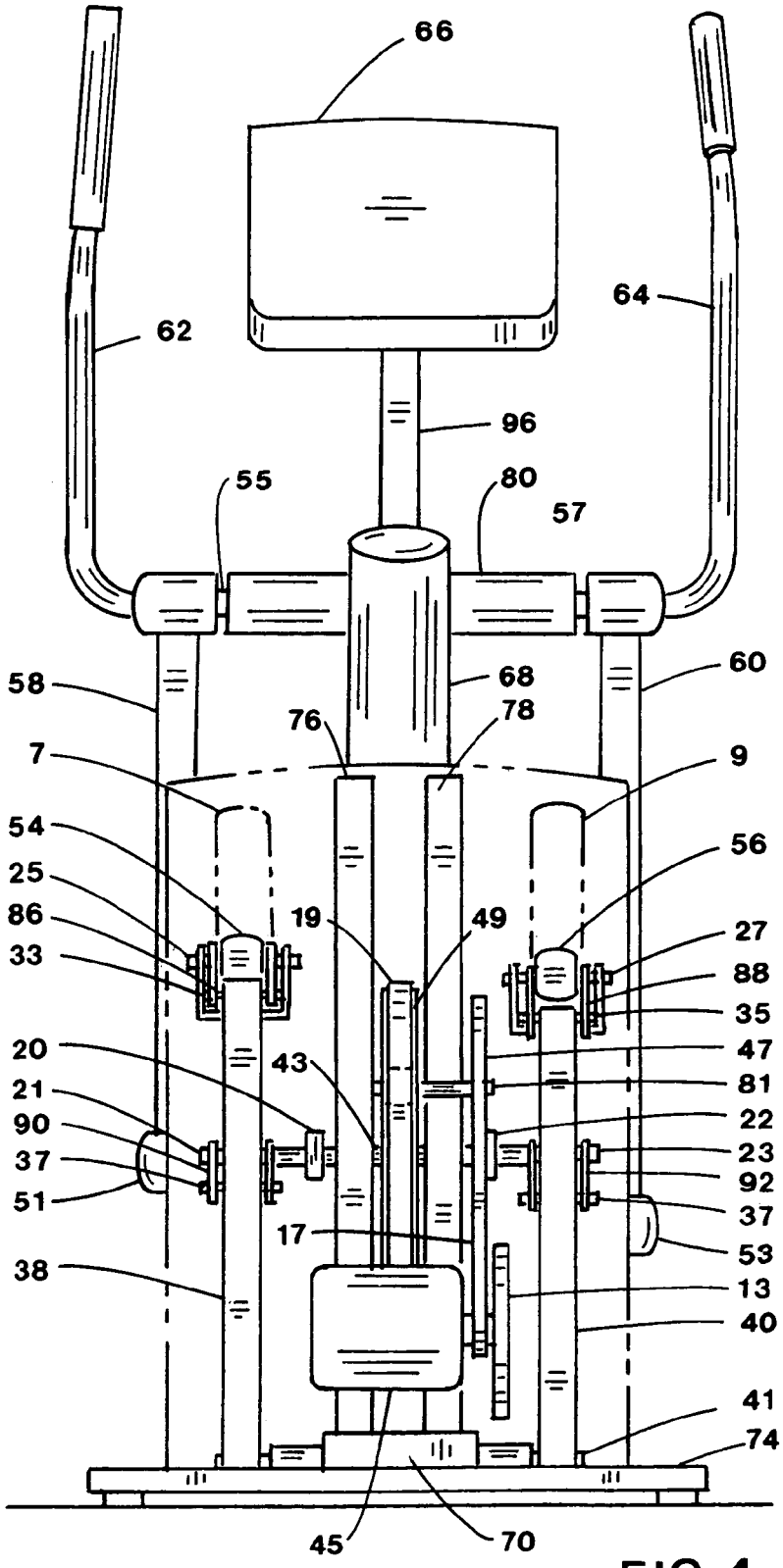
FIG. 4 is a rear view of the alternate embodiment shown in FIG. 3.

A second embodiment is shown in FIGS. 3 and 4 where the path generating linkage of the first embodiment is arranged differently. Orbital links 82,84 and connector links 86,88 are connected to foot support members 54,56 at pivots 25,27. Pivots 25,27 follow orbital path 6. A shroud 3 is shown with slots 7,9 to enclose the drive system to allow foot support members 54,56 to protrude.

Orbital links 82,84 and coupler links 90,92 are connected to crank arms 20,22 at crank pivots 21,23. Rocker links 38,40 are connected to frame member 70 at pivots 41 and to connector links 86,88 at pivots 33,35 as well as coupler links 90,92 at pivots 37,39. Orbital links 82,84 orbit the elliptical path 6 and the orbital path followed by crank arm pivots 21,23. Pedals 50,52 follow elongate closed loop path 11. The remaining portions of the second embodiment are similar to the first embodiment.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of orbital links, each orbital link pivotally connected to said crank and configured such that each portion of said orbital link follows an orbital path;

a pair of path generating linkages, each said linkage including said orbital link and said crank configured to guide said first portion of said foot support member along an orbital path;

a pair of guide links, each said guide link operably associated with said foot support member and said framework to cause said second portion of said foot member to have a back and forth movement;

said pedal configured to move relative to said framework when the foot of the user is rotating said crank whereby said pedal follows an oblong curve path.

2. The exercise machine according to claim 1 wherein said oblong curve path is generally elliptical in shape.

3. The exercise machine according to claim 1 further comprising arm exercise, said arm exercise operably associated with said foot support members.

4. The exercise machine according to claim 3 wherein said arm exercise comprises a pair of handles, each said handle operably associated with a corresponding said guide link.

5. The exercise machine according to claim 1 further comprising a flywheel, said flywheel rotatably connected to said framework and operably associated with said crank.

6. The exercise machine according to claim 5 further comprising a load resistance, said load resistance operably associated with said flywheel, a means for adjustment of said load resistance and, a control system, said control system positioned within reach of the operator whereby said load resistance can be varied during operation of said exercise machine.

7. The exercise machine according to claim 1 wherein said foot support member is configured with said pedal positioned intermediate said first portion and said second portion of said foot support member.

8. The exercise machine according to claim 1 wherein each said path generating linkage further comprises a rocker link, said rocker link pivotally connected to said framework, and a coupler link, said coupler link pivotally connected to said rocker link and said crank.

9. The exercise machine according to claim 8 wherein each said path generating linkage further comprises a connector link, said connector link pivotally connected to said rocker link and said orbital link.

10. The exercise machine according to claim 1 wherein said pedal is offset relative to said first portion of said foot support member.

11. The exercise machine according to claim 1 wherein said oblong curve path has a flat portion, said flat portion positioned on the upper half of said oblong curve path.

12. The exercise machine according to claim 1 further comprising a shroud, said shroud encompassing said crank, said path generating linkages and said first portion of said foot support members whereby said first portion of said foot support members protrude from said shroud.

13. An exercise machine comprising:

a framework, said framework configured to be supported by the floor;

a pair of foot support members, each having a first portion, a second portion and a foot engaging pedal;

a pair of crank arms, each said crank arm rotatably attached to said framework at a common pivot axis positioned rearward of an operator;

a pair of orbital links, each orbital link pivotally connected to a corresponding said crank arm and configured such that each portion of said orbital link follows an orbital path;

a pair of path generating linkages, each said linkage including said orbital link and said crank configured to guide said first portion of said foot support member along an orbital path;

a pair of guide links, each said guide link operably associated with said foot support member and said framework to cause said second portion of said foot member to have a back and forth movement;

said pedal configured to move relative to said framework when the foot of the user is rotating said crank arms whereby said first portion of said foot support member follows said orbital path to exclude encompassing said pivot axis.

14. The exercise machine according to claim 13 wherein each said path generating linkage includes a rocker link, said rocker link pivotally connected to said framework, and a coupler link, said coupler link pivotally connected to said rocker link and said crank arm.

15. The exercise machine according to claim 14 wherein each said path generating linkage includes a connector link, said connector link pivotally connected to said rocker link and said orbital link.

16. The exercise machine according to claim 13 further comprising a load resistance, said load resistance operably associated with said crank arms, a means for adjustment of said load resistance and, a control system, said control system positioned within reach of the operator whereby said load resistance can be varied during operation of said exercise machine.

17. The exercise machine according to claim 13 further comprising arm exercise, said arm exercise operably associated with said foot support members.

18. An exercise machine comprising:

a framework, said framework configured to be supported by the floor;

a pair of foot support members, each having a first portion, a second portion and a foot engaging pedal;

a crank, said crank rotatably attached rearward of an operator to said framework projecting outwardly therefrom on both sides thereof;

a pair of orbital links, each orbital link pivotally connected to said crank and configured such that each portion of said orbital link follows an orbital path;

a pair of rocker links, each said rocker link pivotally connected to said framework;

a pair of coupler links, each said coupler link pivotally connected to a respective said rocker link and to said crank;

a pair of connector links, each said connector link pivotally connected to a respective said rocker link and to a respective said orbital link;

said orbital link configured to guide said first portion of said foot support member along an orbital path;

a pair of guide links, each said guide link pivotally connected to said foot support member and said framework to cause said second portion of said foot member to have a back and forth movement;

said pedal configured to move relative to said framework when the foot of the user is rotating said crank whereby said pedal follows an oblong curve path.

19. The exercise machine according to claim 18 further comprising a pair of handles for arm exercise, each said handle pivotally connected to said framework and operably associated with a respective said foot support member.

* * * * *